US011443872B2

(12) United States Patent
Woeste et al.

(10) Patent No.: US 11,443,872 B2
(45) Date of Patent: Sep. 13, 2022

(54) AUTOMOTIVE COMMUNICATIONS CABLE

(71) Applicant: Aptiv Technologies Limited, St. Michael (BB)

(72) Inventors: Guido Woeste, Schweim (DE); Christian Schäfer, Bochum (DE)

(73) Assignee: APTIV TECHNOLOGIES LIMITED

( * ) Notice: Subject to any disclaimer, the term of this patent is extended or adjusted under 35 U.S.C. 154(b) by 363 days.

(21) Appl. No.: 16/600,291

(22) Filed: Oct. 11, 2019

(65) Prior Publication Data

US 2020/0118712 A1 Apr. 16, 2020

Related U.S. Application Data

(60) Provisional application No. 62/744,589, filed on Oct. 11, 2018.

(51) Int. Cl.

| | |
|---|---|
| ***H01B 11/02*** | (2006.01) |
| ***H01B 13/02*** | (2006.01) |
| ***H01B 13/18*** | (2006.01) |
| ***H01R 43/28*** | (2006.01) |
| *H01B 3/44* | (2006.01) |
| *H01B 13/14* | (2006.01) |

(52) U.S. Cl.

CPC ..... *H01B 11/02* (2013.01); *H01B 13/0207* (2013.01); *H01B 13/18* (2013.01); *H01R 43/28* (2013.01); *H01B 3/445* (2013.01); *H01B 13/14* (2013.01)

(58) Field of Classification Search

CPC ..... H01B 3/445; H01B 7/18; H01B 11/02; H01B 13/0207; H01B 13/14; H01B 13/18; H01R 13/652; H01R 43/28

USPC ..... 174/110–113 R, 113 C, 113 AS, 117 R, 174/117 F, 117 FF, 74 R, 78

See application file for complete search history.

(56) References Cited

U.S. PATENT DOCUMENTS

| | | | | | |
|---|---|---|---|---|---|
| 2,186,793 | A | * | 1/1940 | Wodtke | H01B 7/1895 174/27 |
| 3,433,890 | A | * | 3/1969 | Gabriel | H01B 11/00 174/116 |
| 3,678,177 | A | * | 7/1972 | Lawrenson | H01B 11/00 174/113 C |
| 3,843,831 | A | * | 10/1974 | Hutchison | H01B 7/295 174/116 |
| 4,449,012 | A | * | 5/1984 | Voser | H01B 7/1825 174/70 A |
| 4,546,210 | A | * | 10/1985 | Akiba | H01B 7/303 174/114 R |

(Continued)

FOREIGN PATENT DOCUMENTS

| | | |
|---|---|---|
| EP | 2227600 A1 | 9/2010 |
| JP | 55-157805 A | 12/1980 |

(Continued)

OTHER PUBLICATIONS

Chinese Office Action for CN Application No. 201910976794, dated Aug. 11, 2021, 5 pages.

(Continued)

*Primary Examiner* — William H. Mayo, III
(74) *Attorney, Agent, or Firm* — Billion & Armitage

(57) ABSTRACT

An automotive communications cable includes a cable jacket, a pair of twisted conductors disposed within the cable jacket, and two or more insulating strands disposed within the cable jacket. The two or more insulating strands include a central insulating strand disposed between a first conductor in the pair of twisted conductors and a second conductor in the pair of twisted conductors.

20 Claims, 4 Drawing Sheets

(56) References Cited

U.S. PATENT DOCUMENTS

| | | | | |
|---|---|---|---|---|
| 5,313,020 | A * | 5/1994 | Sackett | H01B 11/002 156/47 |
| 5,808,239 | A * | 9/1998 | Olsson | H01B 7/1895 174/113 C |
| 6,984,788 | B2 * | 1/2006 | Grogl | H01B 7/1895 174/106 R |
| 7,550,677 | B2 * | 6/2009 | Debladis | H01B 7/1825 174/128.1 |
| 7,696,437 | B2 | 4/2010 | Clark et al. | |
| 2014/0220798 | A1 * | 8/2014 | Putt, Jr. | H01R 13/65914 439/95 |

FOREIGN PATENT DOCUMENTS

| | | | |
|---|---|---|---|
| JP | H05-2924 | A | 1/1993 |
| JP | H110-040745 | A | 2/1998 |
| JP | 2002-352641 | A | 12/2002 |
| JP | 2008300248 | A | 12/2008 |
| JP | 43-11574 | | 8/2009 |
| JP | 2012-133982 | A | 7/2012 |
| JP | 2016-4707 | A | 1/2016 |
| WO | 2013066315 | A1 | 5/2013 |

OTHER PUBLICATIONS

Notice of Preliminary Rejection for KR Application No. 10-2019-0125253, dated Feb. 2, 2021, 6 pages.
Translation of KR Preliminary Rejection.
Japanese Office Action from JP Application No. 2019-185637, dated Apr. 7, 2021, 5 pages.
Japanese Office Action for JP Application No. 2019185637, dated Oct. 14, 2020, 4 pages.
Extended European Search Report for EP Application No. 19202426.3, dated Dec. 14, 2020, 7 pages.

* cited by examiner

AUTOMOTIVE COMMUNICATIONS CABLE

CROSS-REFERENCE TO RELATED APPLICATION

This application claims priority to U.S. Provisional Patent Application No. 62/744,589, filed Oct. 11, 2018, the entire contents of which are incorporated herein by reference.

TECHNICAL FIELD

This specification relates to automotive communications cables.

BACKGROUND

Modern vehicles have dozens of electronic control units (ECUs) that obtain sensor data, process the sensor data to generate output signals, and provide the output signals to particular vehicle components that perform actions based on the output signals. For example, a transmission control unit can obtain engine speed data, vehicle speed data, and throttle position data and generate an output signal that defines a desired gear for a vehicle. If the vehicle is not in the desired gear, the transmission can shift to the desired gear in response to the output signal.

Semi-autonomous and autonomous vehicles generally have an even greater number of ECUs than human-operated vehicles because sensor inputs replace some or all human inputs, and those additional sensor inputs must be processed. Moreover, semi-autonomous and autonomous vehicles often include redundant systems in order to satisfy safety requirements.

Generally, each ECU in a vehicle is connected to a central communications network over which the ECUs can exchange data with each other, with external sensors, and with other components of the vehicle. The central communications network includes a number of communications cables that are costly to manufacture and add significant weight to the vehicle. The communications cables in vehicles are generally jacketed unshielded twisted pairs (JUTPs).

SUMMARY

This specification describes an improved communications cable. The communications cable includes a pair of twisted conductors disposed within a cable jacket. Two or more insulating strands are also disposed within the cable jacket. The two or more insulating strands include a central insulating strand disposed between a first conductor in the pair of twisted conductors and a second conductor in the pair of twisted conductors.

The subject matter described in this specification can be implemented in particular embodiments so as to realize one or more of the following advantages. First, the improved communications cable weighs less than a conventional JUTP of the same wire gauge. This is because the lack of an individual insulator for each conductor allows the cable jacket to have a smaller diameter, which reduces the weight of the communications cable due to the cable jacket.

The improved communications cable is cheaper and easier to manufacture than a conventional JUTP because the conductors in the improved communications cable do not have their own insulator. Instead, the improved communications cable has insulating strands that can be extruded at the same time using the same extrusion process, which further simplifies the manufacturing process.

The use of separate insulating strands also provides flexibility in adjusting the relative permittivity of the cable, since the size and material composition of each insulating strand can be adjusted, as necessary.

Finally, the improved communications cable can also be stripped more easily than a conventional JUTP, i.e., by removing the cable jacket and the exterior insulating strands in one stripping process. The central insulating strand holds the conductors in a fixed position, allowing defined insertion into a connector through laser welding or crimping. Additionally, the central insulating strand helps to maintain the twist in the communications cable for the entire length of the cable. This increases noise immunity.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
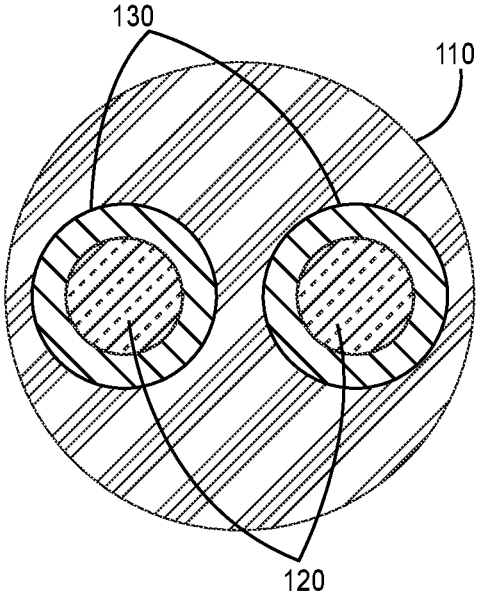
FIG. 1A (PRIOR ART)
FIG. 1A is a diagram of a cross-section of a conventional JUTP, according to an embodiment.

Reference will now be made in detail to embodiments, examples of which are illustrated in the accompanying drawings. In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the disclosed embodiments.

In the drawings, specific arrangements or orderings of schematic elements, such as those representing devices, modules, instruction blocks and data elements, are shown for ease of description. However, it should be understood by those skilled in the art that the specific ordering or arrangement of the schematic elements in the drawings is not meant to imply that a particular order or sequence of processing, or separation of processes, is required. Further, the inclusion of a schematic element in a drawing is not meant to imply that such element is required in all embodiments or that the features represented by such element may not be included in or combined with other elements in some embodiments.

Further, in the drawings, where connecting elements, such as solid or dashed lines or arrows, are used to illustrate a connection, relationship or association between or among two or more other schematic elements, the absence of any such connecting elements is not meant to imply that no connection, relationship or association can exist. In other words, some connections, relationships or associations between elements are not shown in the drawings so as not to obscure the disclosure. In addition, for ease of illustration, a single connecting element is used to represent multiple connections, relationships or associations between elements. For example, where a connecting element represents a communication of signals, data or instructions, it should be understood by those skilled in the art that such element represents one or multiple signal paths (e.g., a bus), as may be needed, to affect the communication.

Several features are described hereafter that can each be used independently of one another or with any combination of other features. However, any individual feature may not address any of the problems discussed above or might only address one of the problems discussed above. Some of the problems discussed above might not be fully addressed by any of the features described herein. Although headings are provided, information related to a particular heading, but not found in the section having that heading, may also be found elsewhere in the specification.

FIG. 1A is a diagram of a cross-section of a conventional JUTP. The conventional JUTP has a cable jacket 110. Two conductors 120, each surrounded by insulators 130, are disposed within the cable jacket 110.

Figure 1B:
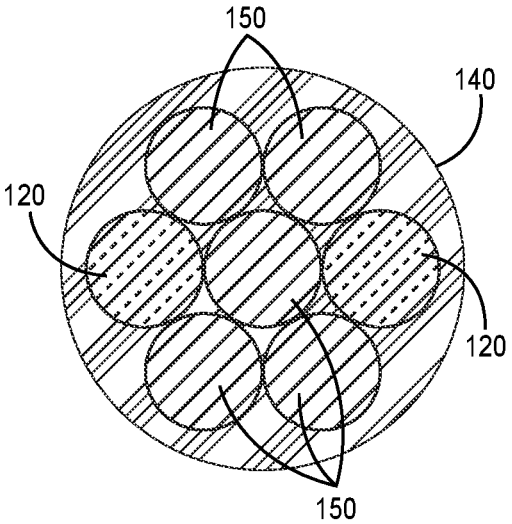
FIG. 1B is a diagram of a cross-section of an improved communications cable, according to an embodiment.

FIG. 1B is a diagram of a cross-section of an improved communications cable. The communications cable includes a cable jacket 140, five insulating strands 150, and two conductors 120 that are identical to the conductors 120 in FIG. 1A.

The cable jacket 140 provides mechanical support to the communications cable and electrically insulates the conductors 120 from the environment. The cable jacket 140 is generally a hollow cylinder and can be made of any appropriate electrical insulator, e.g., any appropriate plastic or rubber material that has enough flexibility to allow insertion into a vehicle.

The conductors 120 are fully disposed within the cable jacket 140. The conductors 120 can be any appropriate electrical conductors. For example, the conductors 120 can be copper Litz wire, which is made of wound strands of copper wire. Alternatively, the conductors 120 can be solid conductors, e.g., single pieces of copper.

The insulating strands 150 are fully disposed within the cable jacket 140 and are generally cylindrical in shape. A central insulating strand disposed between the two conductors 120 separates them from each other. The insulating strands 150 can be made of polytetrafluoroethylene (PTFE), fluorinated ethylene propylene (FEP), or any other suitable material. The use of separate insulating strands provides flexibility in adjusting the relative permittivity of the cable, since the size and material composition of each insulating strand can be adjusted, as necessary. The improved communications cable has a smaller diameter than a conventional JUTP, which reduces its weight and intrinsic impedance.

Figure 2:
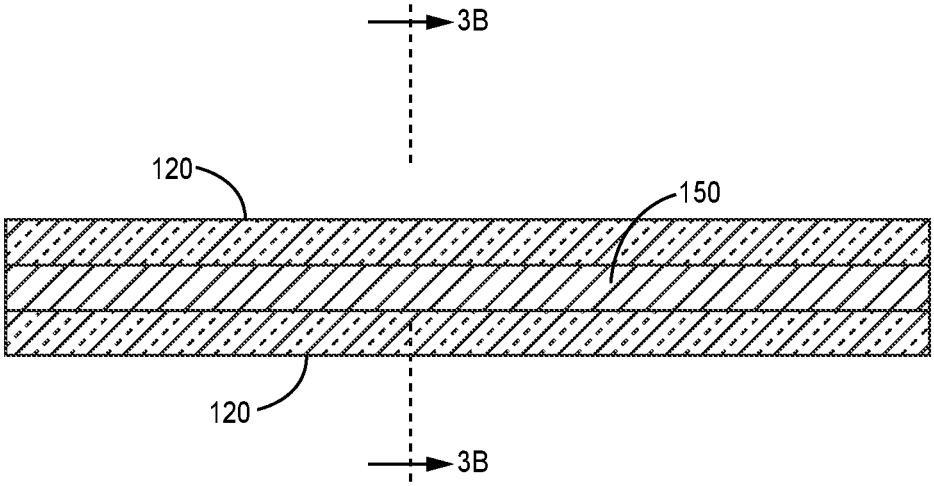
FIG. 2 is a diagram of a side view of the improved communications cable, according to an embodiment.

FIG. 2 is a diagram of a side view of the improved communications cable described in reference to FIG. 1B. FIG. 2 depicts the communications cable without the cable jacket 140.

For simplicity, FIG. 2 depicts an untwisted implementation of the improved communications cable described in reference to FIG. 1B. In some implementations, however, the conductors 120 are twisted about each other. Twisting the conductors 120 reduces the amount of electromagnetic radiation that the communications cable generates and improves rejection of external electromagnetic interference.

Figure 3A:
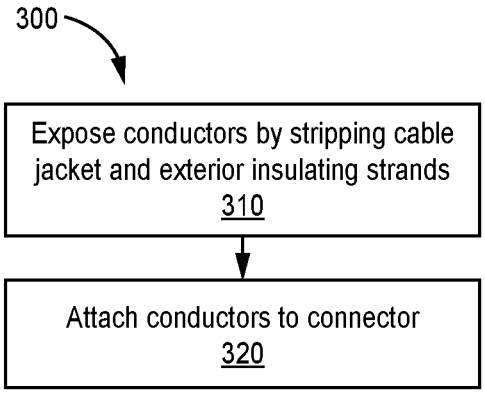
FIG. 3A is a flow chart of an example process for stripping the improved communications cable, according to an embodiment.

FIG. 3A is a flow chart of an example process 300 for stripping the improved communications cable described in reference to FIG. 1B. The process can be performed by a person or by an automated machine that is configured to do so. For convenience, the process will be described as being performed by a person.

Figure 3B:
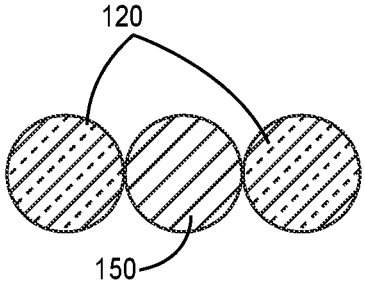
FIG. 3B is a diagram of a cross-section of a stripped version of the improved communications cable, according to an embodiment.

Using conventional wire strippers, a person exposes the conductors by stripping the cable jacket and the four exterior insulating strands away from the conductors in one stripping process (310). This is not possible with a conventional JUTP, in which each conductor additionally has its own insulator that must be separately stripped. FIG. 3B is a diagram of a cross-section of a stripped version of the improved communications cable described in reference to FIG. 1B.

The person attaches the exposed conductors to a connector, e.g., by crimping, laser welding, or soldering the conductors to the connector (320). This is possible because the central insulating strand holds the conductors in place relative to each other. In contrast, after a person strips a conventional JUTP, the conductors are able to move relative to each other, which makes the above-mentioned attachment methods more difficult. Additionally, the central insulating strand helps to maintain the twist in the communications cable for the entire length of the cable. This increases noise immunity.

Figure 4:
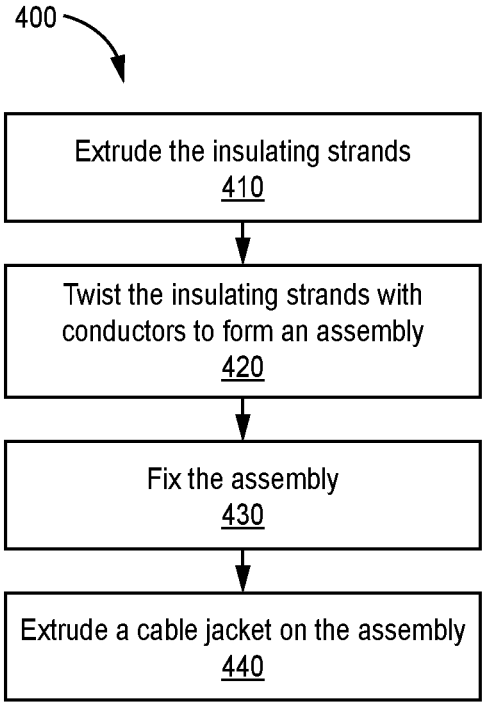
FIG. 4 is a flow chart of an example process for manufacturing the improved communications cable, according to an embodiment.

FIG. 4 is a flow chart of an example process 400 for manufacturing the improved communications cable described in reference to FIG. 1B. For convenience, the process will be described as being performed by an automated system of one or more machines and one or more computers.

The system extrudes each of the five insulating strands in one simple, standard process (410). The system twists the insulating strands with two conductors to form an assembly (420). The system twists the assembly while it is still hot from the extrusion process and then fixes the assembly in the twisted position (430). Fixing the assembly can involve cooling the assembly. Finally, the system extrudes a cable jacket on the assembly (440).

The process 400 requires fewer extrusions than the manufacturing process for a conventional JUTP because the manufacturing process for a conventional JUTP includes extruding insulators on each conductor. The improved communications cable does not have separate insulators for each conductor but instead strands that can be extruded at the same time using the same extrusion process, which further simplifies the manufacturing process.

While this document contains many specific implementation details, the implementation details should not be construed as limitations on the scope of what may be claimed but rather as a description of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub combination. Moreover, although features may be described above as acting in certain combinations and even initially claimed as such, one or more features from a claimed combination can, in some cases, be excised from the combination, and the claimed combination may be directed to a sub combination or variation of a sub combination.

While logic flows or operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various software components in the embodiments described above should not be understood as requiring such separation in all embodiments, and it should be understood that the described software components can generally be integrated together in a single software program or multiple software programs.

In some instances, functions in claims will be preceded with the phrase "one or more." The phrase "one or more" as used herein includes a function being performed by one element, a function being performed by more than one element, e.g., in a distributed fashion, several functions being performed by one element, several functions being performed by several elements, or any combination of the above.

In some instances, claim elements will be preceded with the terms first, second, third and so forth. It should be understood that, although the terms first, second, third, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes, "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context."

Some aspects of the subject matter of this specification may include gathering and use of data available from various sources. The present disclosure contemplates that in some instances, this gathered data may identify a particular location or an address based on device usage. Such personal information data can include location-based data, addresses, subscriber account identifiers, or other identifying information. The present disclosure further contemplates that the entities responsible for the collection, analysis, disclosure, transfer, storage, or other use of such personal information data will comply with well-established privacy policies and/or privacy practices. In particular, such entities should implement and consistently use privacy policies and practices that are generally recognized as meeting or exceeding industry or governmental requirements for maintaining personal information data private and secure.

The invention claimed is:

1. A communications cable, comprising:

a cable jacket;

a pair of twisted conductors disposed within the cable jacket; and a plurality of insulating strands disposed within the cable jacket, wherein the plurality of insulating strands includes a central insulating strand disposed between a first conductor in the pair of twisted conductors, a second conductor in the pair of twisted conductors, and the other insulating strands in the plurality of insulating strands, wherein the cable jacket and all the plurality of insulating strands except the central insulating strand are configured to be stripped in one stripping process to expose the pair of twisted conductors when the cable jacket and the insulating strands other than the central insulating strand are stripped from the communications cable, and wherein the central insulating strand holds the first and second conductors in place relative to each other.

2. The communications cable of claim 1, wherein the first conductor and the second conductor each lack their own insulator.

3. The communications cable of claim 1, wherein the first conductor and second conductor are formed of Litz wire.

4. The communications cable of claim 1, wherein the cable jacket is an electrical insulator.

5. The communications cable of claim 1, wherein the plurality of insulating strands comprise polytetrafluoroethylene.

6. The communications cable of claim 1, wherein the plurality of insulating strands comprise fluorinated ethylene propylene.

7. The communications cable of claim 1, wherein the plurality of insulating strands include a plurality of peripheral insulating strands disposed along a periphery of the central insulating strand and between the first conductor and the second conductor.

8. The communications cable of claim 7, wherein the plurality of peripheral insulating strands includes at least two insulating strands disposed on a first side of the central insulating strand, and at least two insulating strands disposed on a second side of the central insulating strand opposite the first side.

9. A method for attaching a communications cable to a connector, the communications cable comprising:

a cable jacket;

a pair of twisted conductors disposed within the cable jacket, and a plurality of insulating strands disposed within the cable jacket, wherein the plurality of insulating strands includes a central insulating strand disposed between a first conductor in the pair of twisted conductors, a second conductor in the pair of twisted conductors and the other insulating strands in the plurality of insulating strands, the method comprising:

exposing the pair of twisted conductors by stripping the cable jacket and each insulating strand in the plurality of insulating strands except for the central insulating strand in a single stripping process; and attaching the exposed pair of twisted conductors to the connector while the central insulated strand holds the exposed pair of twisted conductors in place relative to each other.

10. The method of claim 9, wherein the attaching step comprises crimping.

11. The method of claim 9, wherein the attaching step comprises laser welding.

12. The method of claim 9, wherein the attaching step comprises soldering.

13. The method of claim 9, wherein the plurality of insulating strands include a plurality of peripheral insulating strands disposed along a periphery of the central insulating strand, and wherein the step of exposing pair of twisted conductors comprises stripping the plurality of peripheral insulating strands.

14. The method of claim 9, further comprising:

extruding the two or more insulating strands simultaneously extruded in an extrusion process;

twisting the two or more insulating strands with a pair of conductors to form an assembly; and extruding the cable jacket on the assembly.

15. The method of claim 14, wherein the plurality of insulating strands include a plurality of peripheral insulating strands disposed along a periphery of the central insulating strand, and wherein twisting the plurality of insulating strands with the pair of twisted conductors to form the assembly comprises twisting the plurality of peripheral insulating strands with the pair of twisted conductors.

16. The method of claim 14, wherein the plurality of insulating strands are extruded concurrently.

17. The method of claim 14, wherein the plurality of insulating strands are twisted with the pair of twisted conductors during a period of time in which the plurality of insulating strand retain heat from an extrusion process.

18. The method of claim 14, further comprising cooling the assembly.

19. The method of claim 14, forming the pair of twisted conductors such that they each lack their own insulator.

20. The method of claim 14, wherein the plurality of insulating strands are extruded from a material comprising at least one of polytetrafluoroethylene or fluorinated ethylene propylene.

* * * * *